US006196214B1

(12) United States Patent
Van Niekerk

(10) Patent No.: US 6,196,214 B1
(45) Date of Patent: Mar. 6, 2001

(54) AIR EXTRACTION APPARATUS

(75) Inventor: Erasmus Van Niekerk, Courcerault (FR)

(73) Assignee: North Star Technologies Ltd., Jersey (GB)

( * ) Notice: Subject to any disclaimer, the term of this patent is extended or adjusted under 35 U.S.C. 154(b) by 0 days.

(21) Appl. No.: 09/139,086

(22) Filed: Aug. 24, 1998

(30) Foreign Application Priority Data

Aug. 25, 1997 (ZA) ..... 97/7614

(51) Int. Cl.[7] ..... F24F 7/06
(52) U.S. Cl. ..... 126/299 D; 126/299 R
(58) Field of Search ..... 126/299 R, 299 D; 454/67; 55/DIG. 36

(56) References Cited

U.S. PATENT DOCUMENTS

| | | | | |
|---|---|---|---|---|
| Re. 22,228 | * | 12/1942 | Petersen | 454/67 |
| 3,064,551 | * | 11/1962 | Stalker | 126/299 D |
| 3,221,635 | * | 12/1965 | Hill, Jr. | 454/67 |
| 3,731,462 | * | 5/1973 | Costarella et al. | 55/DIG. 36 |
| 3,880,062 | * | 4/1975 | Culpepper, Jr. et al. | 55/DIG. 36 |
| 3,943,836 | | 3/1976 | Kuechler | 98/115 K |
| 4,129,121 | | 12/1978 | Dorius | 126/299 D |
| 5,467,761 | | 11/1995 | Kuechler | 126/299 D |

FOREIGN PATENT DOCUMENTS

| | | | | |
|---|---|---|---|---|
| 2 229 378 | | 9/1990 | (GB) . | |
| 357188949 | * | 11/1982 | (JP) | 454/67 |
| 523250 | * | 8/1976 | (SU) | 126/299 D |

* cited by examiner

*Primary Examiner*—Carl D. Price
(74) *Attorney, Agent, or Firm*—Marshall, O'Toole, Gerstein, Murray & Borun

(57) ABSTRACT

An air extraction hood, which comprises a canopy defining an enclosed air collection and treatment zone, and having an operatively downwardly directed air inlet through which air to be treated can enter the zone, as well as an air outlet through which air can be discharged from the zone, the canopy being mountable with clearance above a cooking surface such that its inlet is located above the cooking surface; mounting means for mounting treatment means inside the canopy in the collection and treatment zone, between the inlet and outlet; and passageway defining means defining an air passageway between the inlet and the mounting means along which air can pass, with at least part of the passageway defining means being curved over at least a major portion of the distance from the inlet to the mounting means, to enhance air flow along the passageway.

7 Claims, 4 Drawing Sheets

AIR EXTRACTION APPARATUS

FIELD OF THE INVENTION

This invention relates to an air extraction apparatus. It relates in particular to an air extraction hood mountable over a cooking surface, and to a cooking installation incorporating such a hood.

SUMMARY OF THE INVENTION

According to a first aspect of the invention, there is provided an air extraction hood, which comprises a canopy defining an enclosed air collection and treatment zone, and having an operatively downwardly directed air inlet through which air to be treated can enter the zone, as well as an air outlet through which air can be discharged from the zone, the canopy being mountable with clearance above a cooking surface such that its inlet is located above the cooking surface;

mounting means for mounting treatment means inside the canopy in the collection and treatment zone, between the inlet and outlet;

passageway defining means defining an air passageway between the inlet and the mounting means along which air can pass, with at least part of the passageway defining means being curved over at least a major portion of the distance from the inlet to the mounting means, to enhance air flow along the passageway.

The canopy may be square or rectangular in plan view, and may have a roof, a front wall, a rear wall spaced from the front wall, and a pair of spaced side walls spanning the space between the rear and front walls. In use, the rear wall can thus be mounted against a wall from which the cooking surface also protrudes.

In other embodiments of the invention, two of the canopies may be located side-by-side with a common rear wall, with each canopy then having its own mounting means and passageway defining means. Instead, or additionally, two of the canopies may be located side-by-side with a common front wall or a common side wall. When the canopies are located side-by-side in this fashion, then naturally the canopies, or portions thereof, can be of integral construction and/or the common wall, or a portion thereof, can be omitted, if desired.

The air inlet will then be provided by or in the lower or underside of the canopy. The air inlet may thus be defined between a first inlet defining member extending between the side walls and located in proximity to the front wall; a second inlet defining member also extending between the side walls and located in proximity to the rear wall; and the side walls, eg the operatively lower edges of the side walls.

The passageway defining means may then comprise the side walls, a first passageway wall between the first inlet defining member and the mounting means and providing a first air deflection surface, and a second passageway wall between the second inlet defining member and the mounting means and providing a second air deflection surface, with at least a portion of the second air deflection surface being curved over said at least a major portion of the distance between the inlet and the mounting means.

The first inlet defining member may be the operatively lower edge of the front wall and/or the operatively lower edge of the first passageway wall. Similarly, the second inlet defining member may be the operatively lower edge of the rear wall and/or the operatively lower edge of the second passageway wall. The first and second inlet defining members may thus extend parallel to each other.

The second air deflection surface may be curved along the entire distance from the second inlet defining member to the mounting means, and may be curved along its full width, ie the entire distance from the one side wall to the other side wall.

The second air deflection surface may be concave or dish shaped, when the hood is viewed end on or in vertical section along a plane extending parallel to the side walls.

Similarly, the first air deflection surface may be curved along at least a portion of the distance from the first inlet defining member and the mounting means. Thus, the first air deflection surface may be convex shaped, when the hood is viewed end on or in vertical section along a plane extending parallel to the side walls.

The second inlet defining member may be located at an operatively lower level than the first inlet defining member, when the hood is mounted in position. In other words, the depth of the hood at the rear wall may be greater than its depth at the front wall.

The mounting means may comprise brackets at the upper ends of the passageway walls for releasably holding the treatment means. The hood may thus include treatment means held by the mounting means. The treatment means may comprise a filter for filtering oils and fats from contaminated air passing through the hood. In particular, the treatment means may comprise separation apparatus as described in European Patent Application No. 963083779.9, which is hence incorporated herein by reference. The mounting means will thus be such that the separation apparatus is located at an angle to the horizontal to permit fats and oils which are separated from air to collect in a collection zone thereof located at a lower level than the air inlet of the separation apparatus.

According to a second aspect of the invention, there is provided a cooking installation, which comprises a cooking hob; and an air extraction hood as hereinbefore described, mounted above the hob.

The invention will now be described by way of example with reference to the accompanying diagrammatic drawings.

DETAILED DESCRIPTION OF THE PREFERRED EMBODIMENTS

Figure 1:
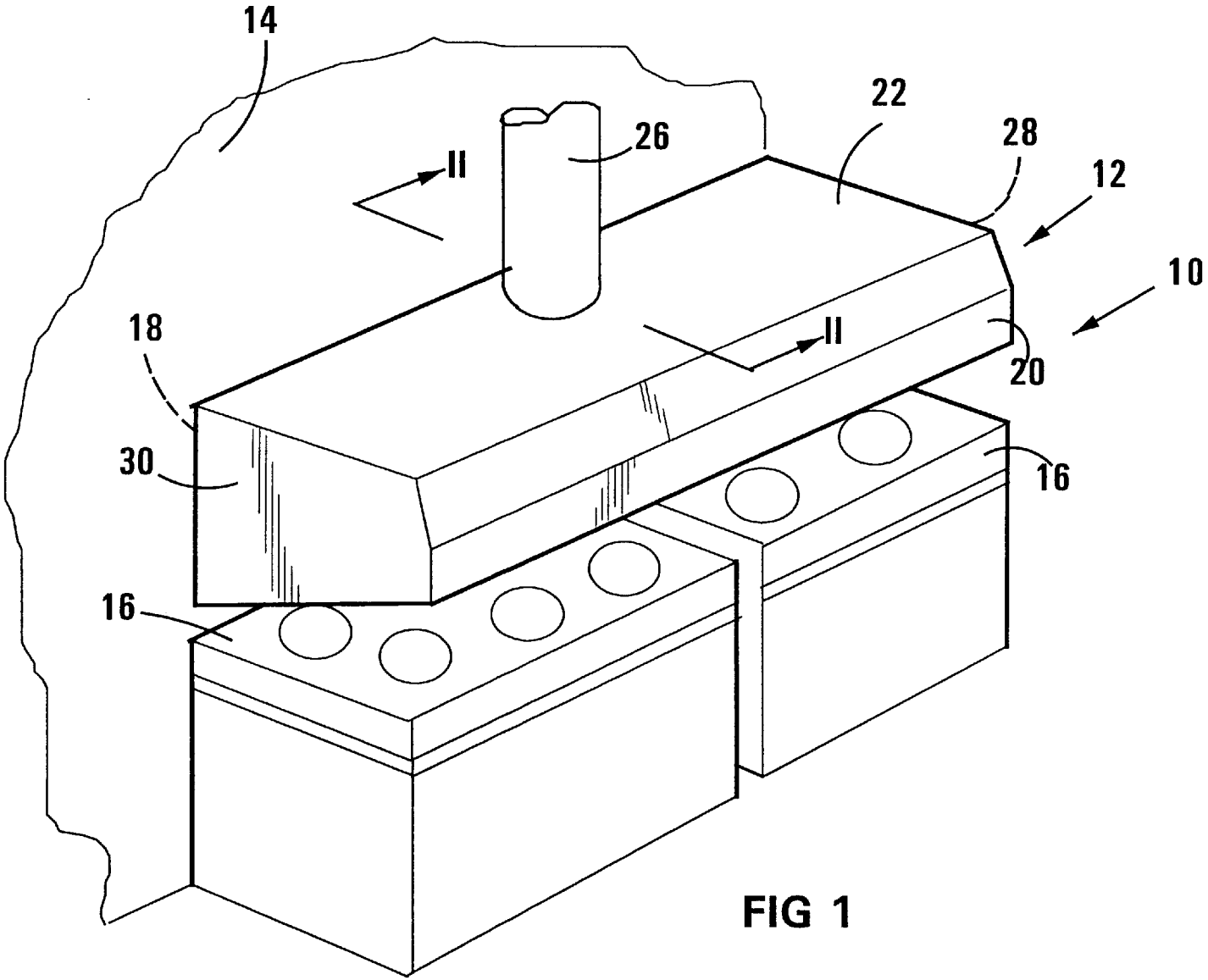
FIG. 1 shows a three-dimensional view of a cooking installation according to the invention, incorporating an air extraction hood according to a first embodiment of the invention.
Figure 2:
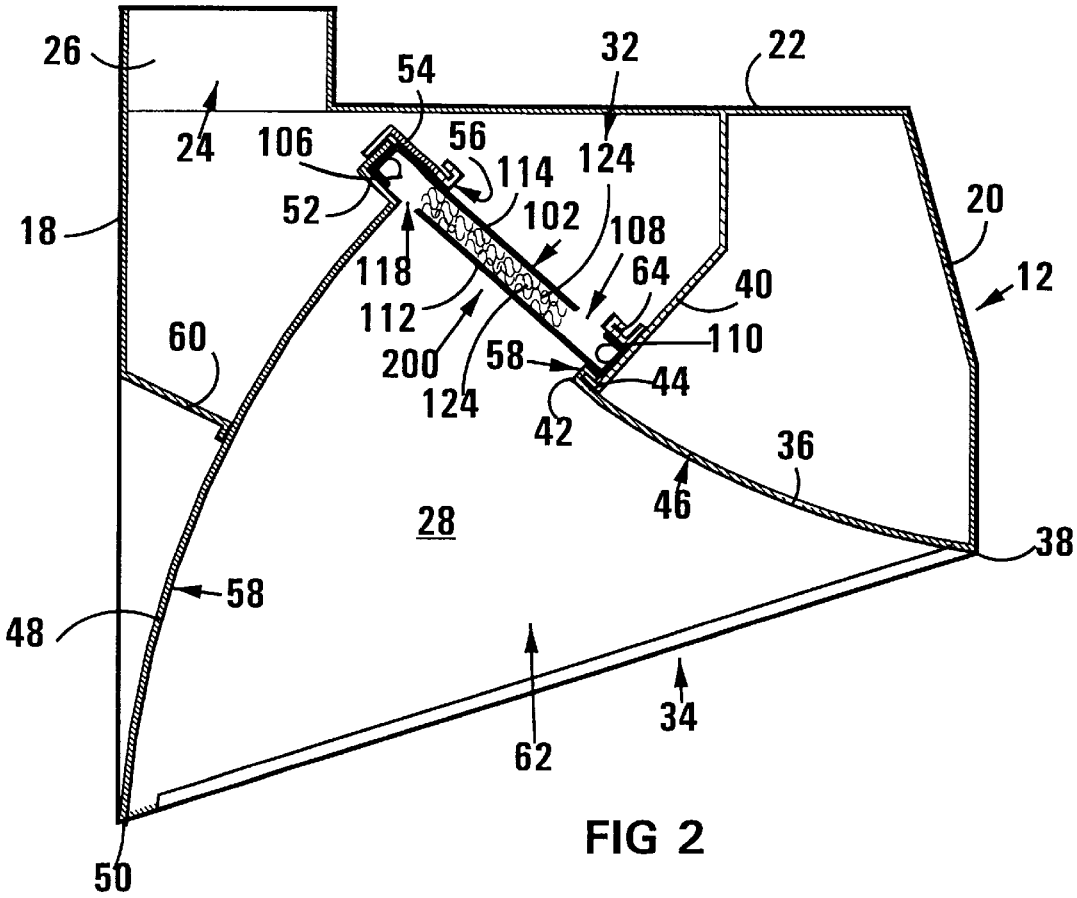
FIG. 2 shows a sectional view through II—II in FIG. 1, with the wall and hob omitted.

Referring to FIGS. 1 and 2, reference numeral 10 generally indicates a cooking installation according to the invention, incorporating an air extraction hood according to a first embodiment of the invention, and which is generally indicated by reference numeral 12.

The cooking installation 10 thus includes the air extraction hood 12 mounted against a wall 14, immediately above a cooking hob 16.

The cooking hood 12 comprises a rear panel or wall 18 mounted against the wall 14, as well as a front wall or panel 20 spaced from the rear panel. The hood 12 also includes a roof or top panel 22 spanning the upper edges of the rear panel 18 and the front panel 20 and provided with an air outlet 24. A conduit or spigot 26 leads from the air outlet 24. The hood 12 also has a pair of side panels 28, 30 closing off the ends of the rear panel 18 and the front panel 20. An enclosed air collection and treatment zone 32 is thus defined between the panels 18, 20, 22, 28 and 30, with the outlet 24 leading from the zone 32, and a downwardly directed air inlet 34 leading into the zone 32.

A first passageway wall 36 extends the full distance from the side wall 28 to the side wall 30, from the lower edge 38 of the front panel 20 to the lower edge of a wall 40 depending from the roof 22. A lip 42 along the upper end of the wall 36 folds over a flange 44 protruding from the wall 40. The wall 36 provides an air deflecting surface 46 which is convex in cross-section as seen in FIG. 2.

A second passageway wall 48 is provided in proximity to the rear panel or wall 18. The passageway wall or panel 48 has a lower edge 50 which extends parallel to the edge 38 of the wall panel 20 but is located at a lower level than the edge 38. The passageway panel 48 has, along its upper edge, a flange shaped component 52 to which is attached a complementary flange shaped component 54 such that the components 52, 54 between them define a recess 56. The passageway wall 48 has an air deflecting surface 58 which is concave in cross-section as seen in FIG. 2. The passageway wall 48 is attached to an inwardly protruding portion 60 of the rear wall 18, as well as to the side walls or panels 28, 30.

The passageway walls 36, 48 and side walls 28, 30 thus define between them an air passageway 62.

A flange-like component 64 is also attached to the wall 40 such that a recess 58 is defined between the flange 44 and the component 64. The recesses 56, 58 are aligned and accommodate, in removable fashion, a separation apparatus 200. The separation apparatus 200 is substantially in accordance with the separation apparatus 200 described in FIG. 7 of European Patent Application No. 96308377.9 which is incorporated herein by reference. Thus, the separation apparatus 200 comprises a vessel 102 providing a separation zone. The vessel 102 comprises a roof 106 which is rectangular in plan view. The vessel 102 also has wall panels 112, 114 with an air inlet 118 being provided in the wall panel 112 at a relatively high level adjacent the roof 106. The air inlet 118 extends the full length of the wall panel 112. An air outlet 108 is provided at a low level in the wall 114 and extends the full length of the wall panel 114. A floor 110 joins the wall panels 112, 114 and is thus spaced from the roof 106. End panels close off the wall panels 112, 114 and extend from the floor 110 to the roof 106.

A fat/oil collection zone is provided inside the vessel adjacent the floor 110.

A bed 124 of curled separating media is associated with the air inlet 118, with the bed being located inside the vessel 102. The bed 124 rests on an apertured support (not shown) which may be in the form of a piece of mesh or the like, with a further similar apertured support (not shown) located on top of the bed to hold the curled separating media in position. Contaminated air thus passes downwardly through the bed from the inlet 118 to the outlet 108. The curled separating media are typically manufactured from stainless steel, and are as described in EP 96308377.9.

Air extraction means (not shown) such as a fan or blower, is located in the conduit 26.

In use, as foodstuffs are cooked on the hob 14, fats and oils, in gaseous form, are discharged into the atmosphere immediately above the hob. As a result of the blower or fan located in the conduit 26, this air is drawn into the air passageway 62, with the air flow along the air deflecting surface 58 being laminar. The contaminated air passes through the separating apparatus 200 where oils and fats are condensed therefrom and collect in the collection zone of the apparatus 200. Purified air passes through the outlet 108 of the separating apparatus 200 and is withdrawn through the outlet 24 along the conduit 26 for discharge to the atmosphere. From time to time the fats and oils which have collected in the collection zone of the separation apparatus 200 must be removed/dispensed of. The separation apparatus 200 will be removed by sliding it upwardly into the recess 56 until the lower edge thereof disengages the lip of flange 44, thereby to permit it to be removed. Excess oil can then be poured from it whereafter it can be washed, eg in a dishwasher, to further clean it and to clean the curled separating media therein. It is then reinstalled by reversing the above operation.

The Applicant believes that the air extraction hood 12, having the curved air deflecting surface 58 in its air passageway 62, has substantial advantages over known cooking hoods not having such a curved air deflection surface. Thus, when the hood 10 is sized such that air flow along the surface 58 is laminar, typically having a velocity in the range of 4m/sec, good air extraction from the zone immediately above the hob 14 is experienced.

Thus, air flow will be along the top of the hob from the leading edge thereof towards the wall 14, upwardly along the wall 14, along the surface 58 and through the separation apparatus 200. In contrast, in known hoods, the air movement is directly upwardly leading to substantial inefficiencies. For example, the sizing of the conduits 26 and the extraction means in known installations must be substantially greater than that of the installation 10 to obtain the same extraction efficiency.

Still further, it is no longer necessary for the edge 38 of the front wall or panel 20 to overhang the leading edge of the hob 14. With known air extraction hoods, the leading edge of the front panel must overhang the leading edge of the hob, typically by about 150mm, in order to obtain satisfactory extraction of air from the zone immediately above the hob into the hood.

More specifically, with known air extraction hoods, a large percentage, typically 80% of the air drawn into the hood is external air, ie not drawn in from the zone immediately above the hob 14. The conduit 26 and air extraction means must thus be oversized in order to handle this excess air as well as the contaminated air from the zone immediately above the hob 14. This disadvantage is to a large extent obviated with the hood 12 where substantially all the air drawn into the hood is from the zone immediately above the hob 14 as a result of the laminar flow induced along the concave surface 58 of the passageway wall 48.

Additionally, with known air extraction hoods, it is normally necessary that the leading edge of the front panel thereof be located a minimum distance from a floor to provide the necessary heads or movement space for people using cooking apparatus. With the hood 12, this minimum distance is no longer necessary and the hood 12 can thus be located at a lower level so that it can be used in more confined spaces.

Figure 3:
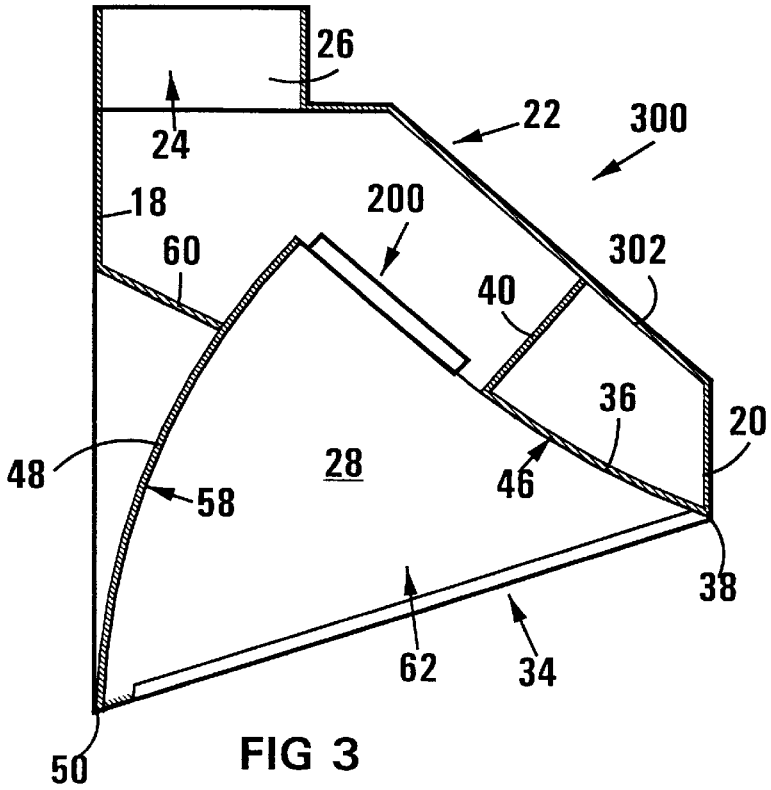
FIG. 3 shows a sectional view, similar to that of FIG. 2, of an air extraction hood according to a second embodiment of the invention.

With reference to FIG. 3, reference numeral 300 generally indicates an air extraction hood according to a second embodiment of the invention.

Parts of the hood 300 which are the same or similar to those of the hood 12, are indicated with the same reference numerals.

The hood 300 is thus very similar to the hood 12 save that its front panel 20 is much narrower, with the roof panel 22 having a downwardly forwardly sloping portion 302.

Typically, the maximum depth of the hood 300 is about 700mm, the maximum distance it protrudes from the wall 14 about 700mm, the radius of curvature of the surface 58 about 800mm and the radius of curvature of the surface 46 about 600mm.

Figure 4:
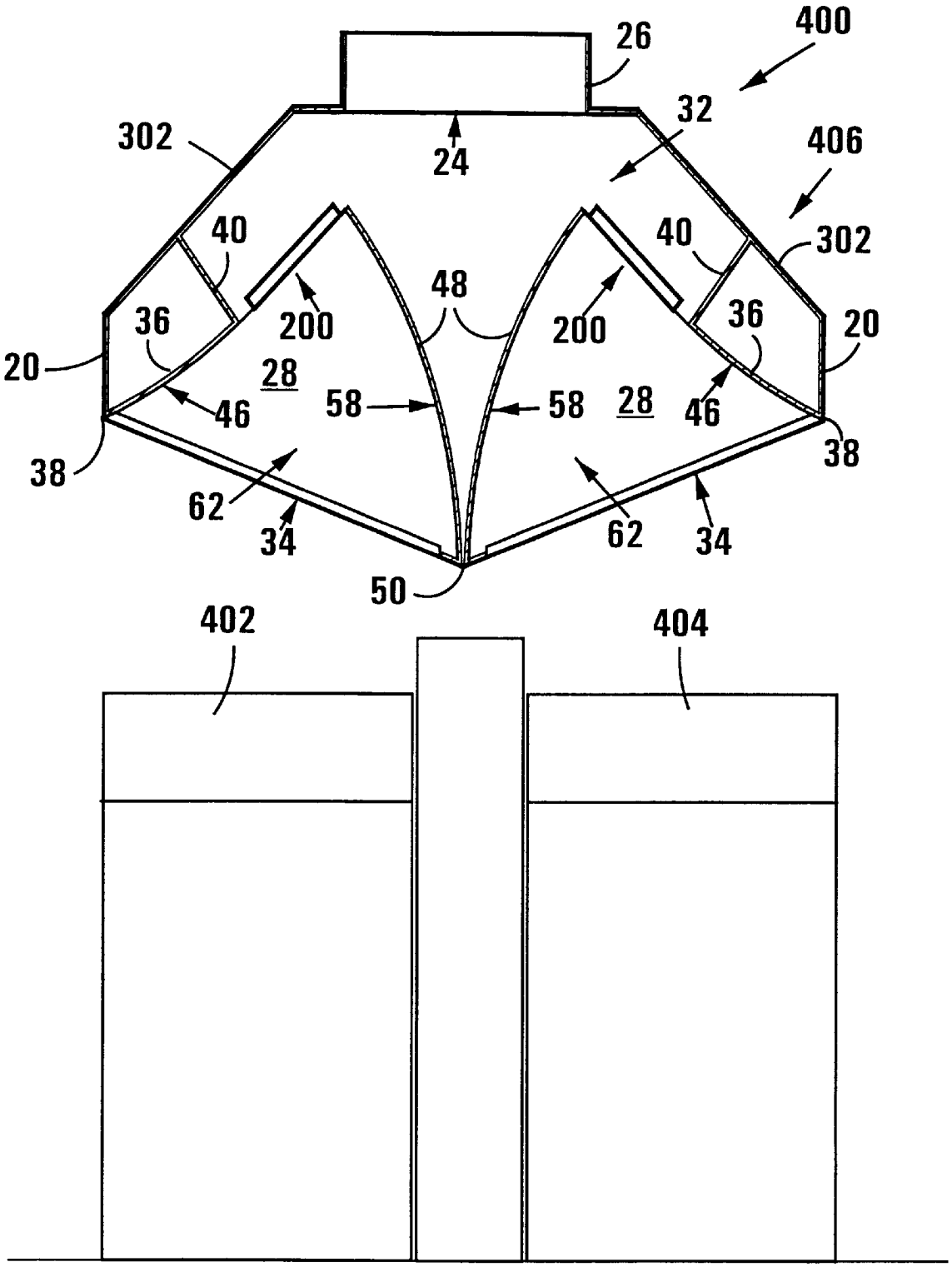
FIG. 4 shows a sectional view, similar to that of FIG. 2, of an air extraction hood according to a third embodiment of the invention, mounted above cooking hobs.

Referring to FIG. 4, reference numeral 400 generally indicates a cooking installation according to another embodiment of the invention incorporating an air extraction hood according to a third embodiment of the invention.

Parts of the installation 400 which are the same or similar to parts of the installations of FIGS. 1 to 3, are indicated with the same reference numerals.

The installation 400 includes two cooking hobs 402, 404 located adjacent each other. The hobs 402 and 404 are effectively free-standing, ie they are not located against a peripheral wall of a kitchen. A composite air extraction hood 406 is located above the hobs 402, 404. Effectively, the hood 406 can be considered a composite of two of the hoods 12 or 300, with the rear panels 18 thereof having been dispensed with.

Figure 5:
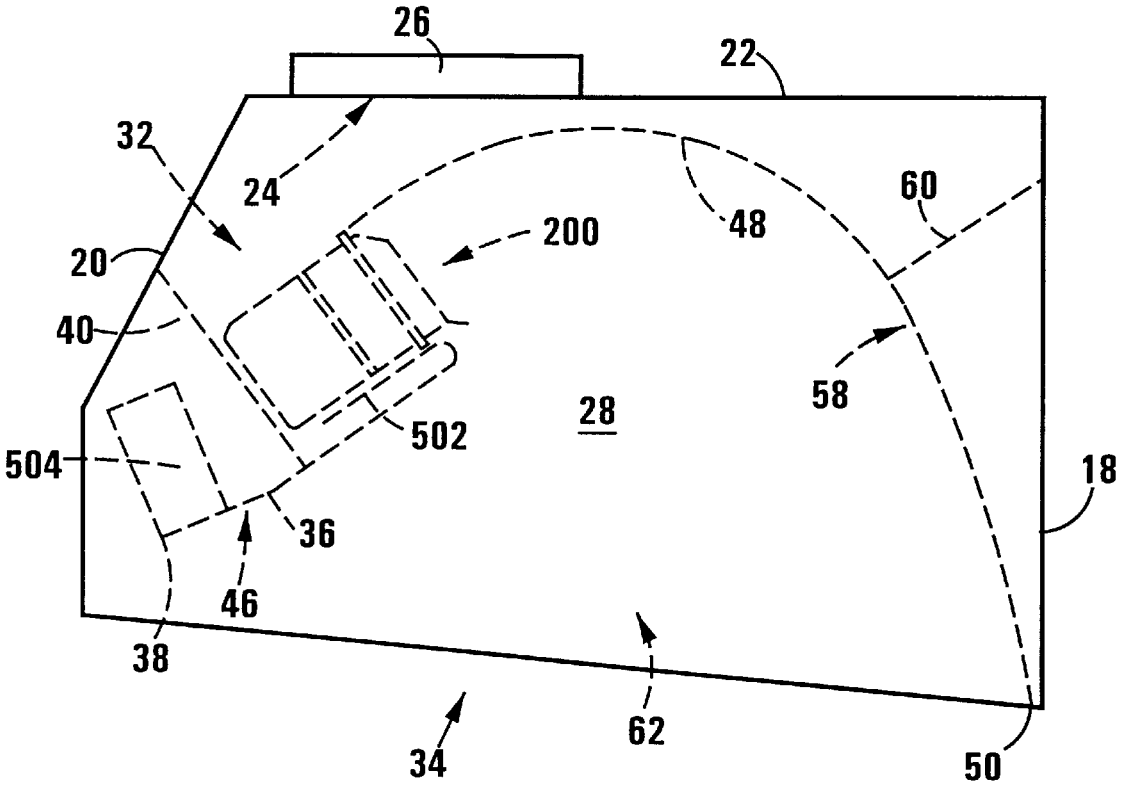
FIG. 5 shows a side view of an air extraction hood according to a fourth embodiment of the invention.

Referring to FIG. 5, reference numeral 500 generally indicates an air extraction hood according to a fourth embodiment of the invention.

Parts of the air extraction hood 500 which are the same or similar to parts of the air extraction hood 12 of FIGS. 1 and 2, are indicated with the same reference numerals.

In the air extraction hood 500, the passageway wall 36 extends some distance beyond the wall 40, and has a reentrant or folded back portion 502 on which rests the separation apparatus 200. The separation apparatus 200 is somewhat larger than that shown in FIGS. 1 and 2 and of slightly different construction, but functions in the same manner.

A hood or canopy light 504 is mounted in the passageway wall 36 such that it directs light downwardly from the surface 46.

The air extraction hood 500 is capable of handling $0.303m^3/s$ of air at 250 Pa, per 0.5 length of the hood.

What is claimed is:

1. An air extraction hood, which comprises a canopy which is square or rectangular in plan view; which has a roof, a front wall, a rear wall spaced from the front wall, and a pair of spaced side walls spanning the space between the rear and front walls; said canopy defining an enclosed air collection and treatment zone; said canopy including a downwardly directed air inlet through which air to be treated can enter the zone, as well as an air outlet through which air can be discharged from the zone, and with the air inlet being defined between lower edges of the side walls, and between a first inlet defining member, extending between the side walls and located in proximity to the front wall, and a second inlet defining member, also extending between the side walls and located in proximity to the rear wall at a lower level than the first inlet defining member so that the depth of the hood at the rear wall is greater than its depth at the front wall;

mounting means for mounting treatment means inside the canopy in the collection and treatment zone, between the air inlet and the air outlet; and passageway defining means defining an air passageway between the air inlet and the mounting means along which air can pass, with the passageway defining means comprising the side walls, a first passageway wall between the first inlet defining member and the mounting means and providing a first air deflection surface, and a second passageway wall between the second inlet defining member and the mounting means and providing a second air deflection surface, said second air deflection surface being concave or dish shaped, when the hood viewed end on or in vertical section along a plane extending parallel to the side walls, with at least a portion of the second air deflection surface being curved over at least a major portion of the distance between the air inlet and the mounting means, to enhance air flow along the passageway.

2. An air extraction hood as claimed in claim 1, wherein the first inlet defining member is the lower edge of the front wall, while the second inlet defining member is the lower edge of the rear wall, with the first and second inlet defining members extending parallel to each other.

3. An air extraction hood as claimed in claim 2, wherein the second air deflection surface is curved along the entire distance from the second inlet defining member to the mounting means, as well as along the entire distance from the one side wall to the other side wall.

4. An air extraction hood as claimed in claim 1, wherein the first air deflection surface is curved along at least a portion of the distance from the first inlet defining member and the mounting means.

5. An air extraction hood as claimed in claim 4, wherein the first air deflection surface is convex shaped, when the hood is viewed end on or in vertical section along a plane extending parallel to the side walls.

6. An air extraction hood as claimed in claim 1, wherein the mounting means comprises brackets at the upper ends of the passageway walls for releasably holding the treatment means.

7. An air extraction hood as claimed in claim 6, which includes treatment means held by the brackets, the treatment means comprising a filter for filtering oils and fats from contaminated air passing through the hood, with the mounting means being such that the filter is located at an angle to the horizontal to permit fats and oils which are separated from air to collect in a collection zone thereof located at a lower level than an air inlet of the filter.

* * * * *